United States Patent [19]

Shimizu

[11] 4,044,545

[45] Aug. 30, 1977

[54] WORLD CLOCK

[75] Inventor: Teruo Shimizu, Katano, Japan

[73] Assignee: Matsushita Electric Industrial Co., Ltd., Osaka, Japan

[21] Appl. No.: 636,641

[22] Filed: Dec. 1, 1975

[30] Foreign Application Priority Data

| | | |
|---|---|---|
| Dec. 11, 1974 | Japan | 49-150513[U] |
| Dec. 11, 1974 | Japan | 49-150514[U] |
| Dec. 11, 1974 | Japan | 49-150515[U] |
| Dec. 13, 1974 | Japan | 49-151901[U] |
| Dec. 13, 1974 | Japan | 49-151902[U] |
| Dec. 13, 1974 | Japan | 49-151903[U] |
| Dec. 13, 1974 | Japan | 49-151904[U] |

[51] Int. Cl.[2] ..... G04B 19/22; G04B 19/24; G04B 19/02

[52] U.S. Cl. ..... 58/42.5; 58/4 A; 58/50 R

[58] Field of Search ..... 58/42.5, 4 A, 50 R; 315/169 TV

[56] References Cited

U.S. PATENT DOCUMENTS

| | | | |
|---|---|---|---|
| 3,186,158 | 6/1965 | Miller | 58/42.5 |
| 3,653,204 | 4/1972 | Miwa | 58/42.5 |
| 3,940,920 | 3/1976 | Nakamura | 58/42.5 |

*Primary Examiner*—E. S. Jackmon
*Attorney, Agent, or Firm*—Stevens, Davis, Miller & Mosher

[57] ABSTRACT

A world clock comprises a cabinet including a front plaque carrying a world map, a time display board slanted to face the viewer for easy reading of the displayed time, a plural pair consisting of a touch pin and a signal light disposed in the neighborhood of each other in the world map and electric circuit means contained in the cabinet for displaying the time at the place of use in the time display board when no touch pin is touched with a finger and displaying the time at a desired district in the time display board and lighting a corresponding signal light at the desired district in the world map. The time display board can be easily exchanged by releasing a simple engagement. The pair consisting of a touch pin and a signal light source may be integrated. From this device one can easily know the time at a desired district in the world simply by touching a touch pin at the desired position in the world map.

5 Claims, 12 Drawing Figures

WORLD CLOCK

BACKGROUND OF THE INVENTION

1. Field of the Invention

This invention relates to a world clock, and more particularly to a high grade world clock capable of displaying the time at any place in the world simply by touching the place on the world map.

2. Description of the Prior Art

Generally, world clocks for displaying the time at various districts in the world have been publicly known, but all of them have been accompanied by various operational problems such as difficulties in rapidly learning the time at a desired district (city), and in the configuration and operation of the clock from the human engineering viewpoint. Further, from the point of design, they have not given the impression of being high grade products.

All of these world clocks have problems from the point of convenience in use. The correspondence between the displayed time and the district in the world in which this time is used is not apparent. Thus, they are very inconvenient to use.

The use of display boards such as liquid crystal display boards for the display of time has been increased, but they do not yet have a satisfactory in-service life and reliability. Therefore, it is necessary for the mounting means for such display means to provide easy exchangeability of the display means.

This invention is intended to eliminate such conventional drawbacks.

SUMMARY OF THE INVENTION

An object of this invention is to provide a world clock which is very east to use even by those having no knowledge of the time difference in the various districts in the world, can provide the time at a desired district instantly, and has a simple shape giving the impression of high quality.

An object of this invention is to provide a world clock having a cabinet which is of low cost but gives the impression of high quality.

An object of this invention is to provide a world clock which provides apparent correspondence between the time displayed on a time display board and the district in a world map in which the displayed time is used.

An object of this invention is to provide a world clock having a display board mounting means such that it provides easy replacement of the display board.

An object of this invention is to provide a world clock having touch indicator means of simple structure including touch switch means.

An object of this invention is to provide a world clock having a touch terminal mounting means which can easily mount the touch terminals of the touch switch means and facilitates the electric connection of the touch terminals to a printed wiring board.

DESCRIPTION OF THE PREFERRED EMBODIMENT

Figure 1:
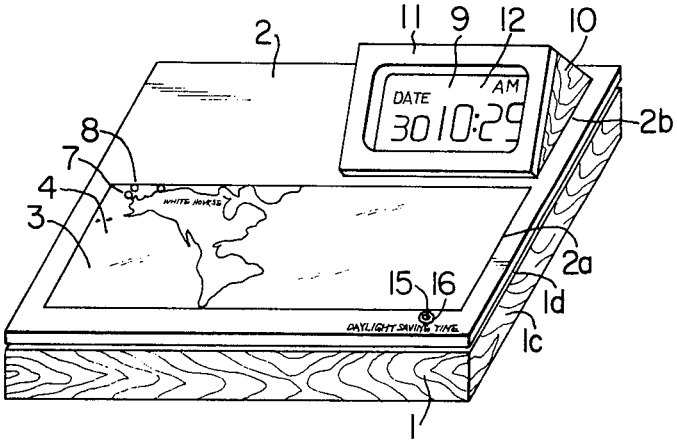
FIG. 1 is a perspective view of an embodiment of the world clock according to the present invention.
Figure 2:
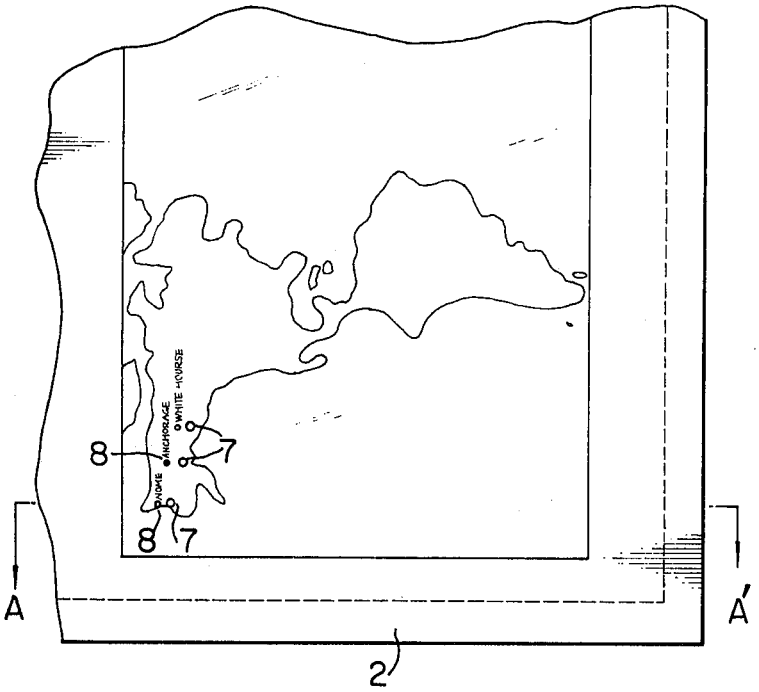
FIG. 2 is a plan view of the map portion of the world clock of FIG. 1.
Figure 3:
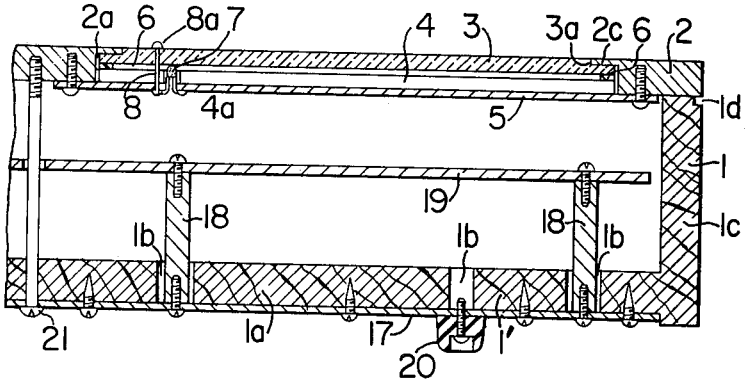
FIG. 3 is a cross-sectional view along the line A—A' in FIG. 2.
Figure 4:
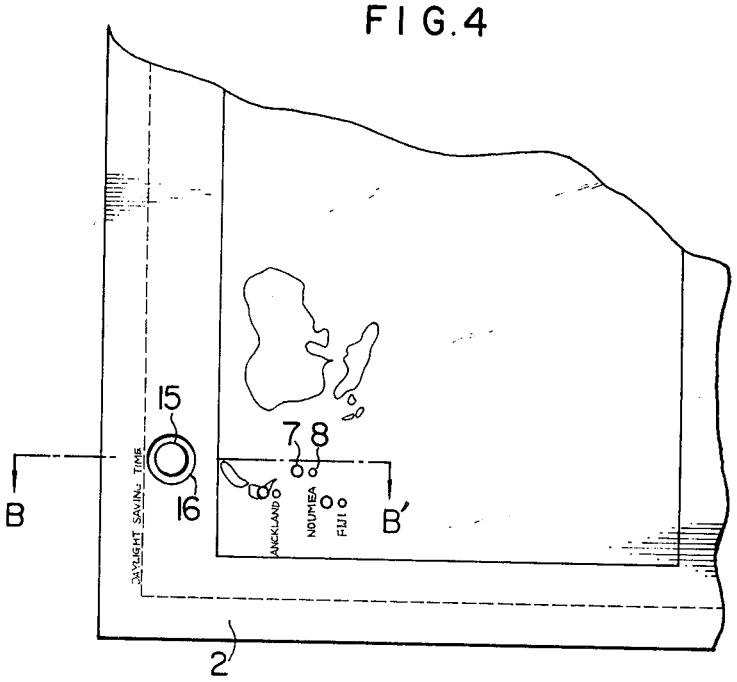
FIG. 4 is a plan view of the portion of the daylight saving time compensating means of the world clock of FIG. 1.
Figure 5:
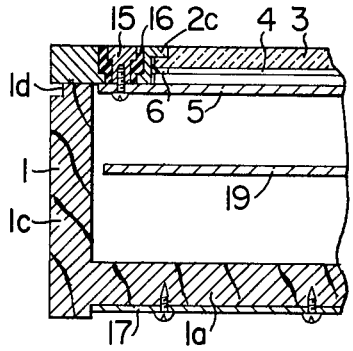
FIG. 5 is a cross-sectional view along the line B—B' in FIG. 4.
Figure 7:
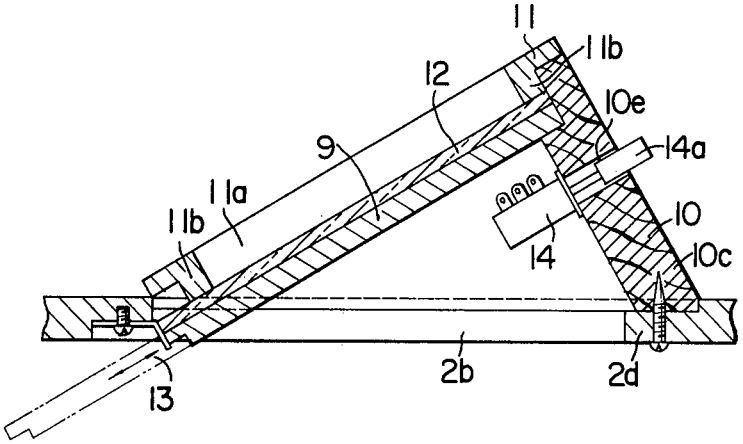
FIG. 7 is a cross-sectional view of the time display portion of FIG. 6.
Figure 6:
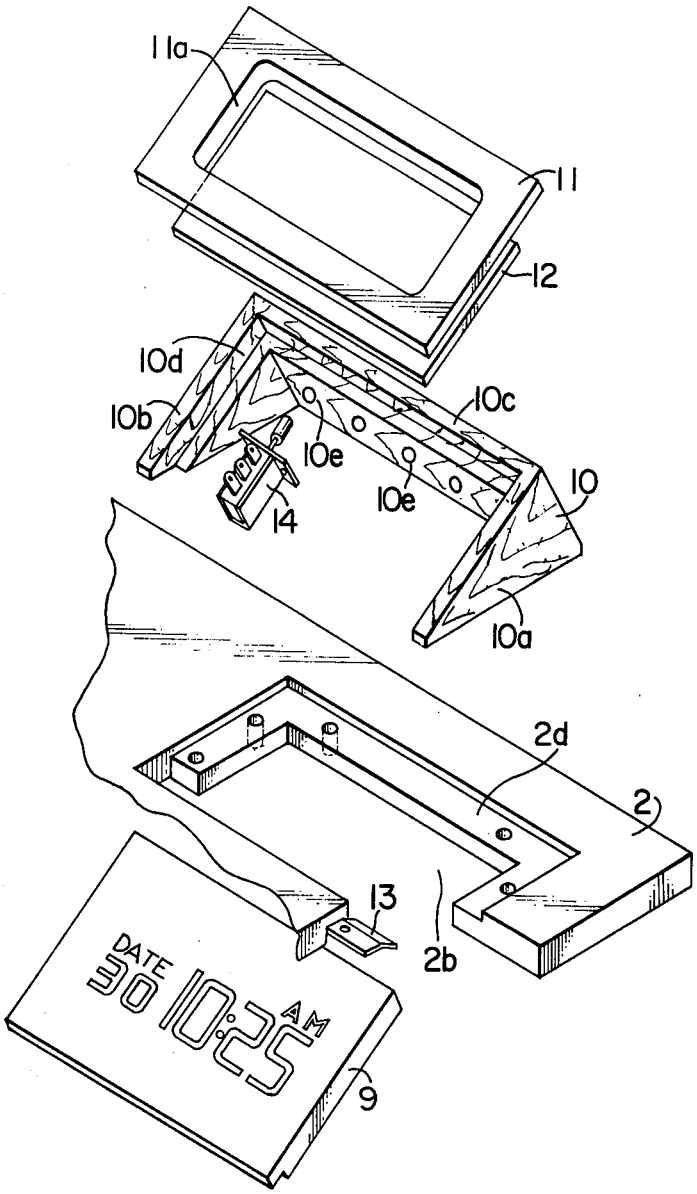
FIG. 6 is an exploded perspective view of the time display portion of the world clock of FIG. 1.

FIGS. 1 through 8 show an embodiment of the world clock of this invention. In the figures, numeral 1 indicates a wooden housing box constituting a cabinet and comprising a bottom board 1*a* provided with several through holes 1*b* and side boards 1*c*. In the outer periphery of the upper end of the side boards 1*c*, a cut-away seat 1*d* is provided. The upper end of the wooden box 1 is open, and a front plaque 2 formed of a metal plate of aluminum, etc. is mounted on the open end of the wooden box 1. In the metal plaque 2, there are provided two openings 2*a* and 2*b* for exposing a world map board and for attaching a time display portion. On the upper periphery of the opening 2*a* in the metal plaque 2, a surrounding projection 2*c* is formed. A transparent panel 3 is fitted in the opening 2*a* in the metal plaque 2 from below and has a surrounding groove 3*a* on the upper periphery (projection on the lower periphery) to receive the projection 2*c* of the metal plaque 2. A world map board 4 carrying a world map is also fitted in the opening 2*a* on the inside surface of the transparent panel 3 through a ring shaped buffer member 6. At the positions of the main cities in the world map, through holes 4*a* are formed in the world map board 4 for inserting electroluminescent diodes. A printed wiring board 5 is fixed on the inner surface of the metal plaque 2 by screws, etc. and also serves to support the world map board 4 at a predetermined position with its upper surface in close contact with the lower surface of the map board 4. Electroluminescent diodes 7 are inserted into the through holes 4*a* formed in the map board 4 to have their top ends projected above the upper surface of the map board 4. The lead-out wires of these electroluminescent diodes are connected to the upper foil layer on the printed wiring board 5 electrically and mechanically. Metal touch pins 8 project through the transparent panel 3, the map board 4 and the printed wiring board 5 from the upper surface of the transparent panel 3 and are connected to the copper layer on the printed wiring board 5 in the neighborhoods of the electroluminescent diodes 7, each pin corresponding to one diode. Each touch pin 8 has a pin head 8*a*. These touch pins 8 also serve to integrate the transparent panel 3, the map board 4 and the printed wiring board 5. The time display portion includes a time display board 9 formed of a liquid crystal display, etc. and assembled to have angle with respect to the metal plaque 2 above the opening 2*b*. Numeral 10 indicates a wooden support for holding the time display board 9 in a slanted state. Side plate members 10*a* and 10*b* of the support 10 are shaped in the form of similar triangles which have a decreasing height from the rear to the front side. As seen in FIGS. 6 and 7 the opening 2*b* is provided with a U-shaped seat 2*d* on three of the four sides. The bottom end surface of the support members 10*a*, 10*b* and 10*c* is mounted on this seat 2*d* and fixed thereon by screws, etc. Thus, the support means 10 forms a slanted rectangular opening at the upper periphery. Another seat 10*d* is formed on the inner periphery of this opening for mounting the time display board 9. A plaque 11 has a window opening 11*a* at the central portion and a continuous projection 11*b* below the inner periphery of the opening 11*a*. This plaque 11 is loaded on the support means 10 by press-inserting this projection 11*b* into said seat 10*d*. A colored transparent plate 12 is also fitted in the seat 10*d* on the time display board 9 and held between the time display board 9 and the projection 11*b* of the plaque 11. A stopper metal 13 is fixed with screws, etc. on the lower surface of the metal plaque 2 at one edge of the opening 2*b* provided with no projection, and supports the lower end of the time display board 9 and the colored transparent plate 12 fitted in the seat 10*d* in the support means 10 to prevent the time display plate 9 and the colored transparent plate 12 from falling out. A switch 14 for adjusting the date and time is fixed on the back plate 10*c* of the support means 10. This switch 14 has an operation shaft projecting above the back plate 10*c* through a hole 10*e*. On the top end of this shaft, a knob 14*a* is provided. Daylight saving time is employed in some districts of the world. A touch piece 15 for compensating for daylight saving time is disposed near the opening 2*a* for the world map and fitted in a hole in the metal plaque 2 through an insulator ring 16 formed of a synthetic resin. A screw is screwed into this touch piece from below for fixing the printed wiring board 5 and electrically connecting the touch piece with the copper foil on the printed board 5. On the outer surface of the bottom board 1*a* of the wooden housing 1, a metal bottom plate 17 is fixed by screws, etc. and reinforces the bottom board 1*a*. Spacer members 18 are inserted into the through holes 1*b* formed in the bottom board 1*a* and fastened on the upper surface of the bottom plate 17 by screws, etc. A printed wiring board 19 carrying the clock circuit is mounted on these spacers 18 and fastened by screws, etc. Legs 20 formed of rubber, etc. are fastened to the lower surface of the bottom plate 17 by screws, etc. Screws 21 are fastened to the metal plaque 2 through the bottom plate 17 and the bottom board 1*a* to fix the metal plaque 2.

The touch piece 15 for compensating for daylight saving time has larger and smaller diameter portions. The insulating ring 16 for receiving the touch piece 15 also has a larger and a smaller diameter portions. Further, the through hole formed in the metal plaque 2 for receiving these also has a larger and a smaller diameter portions. The printed wiring board 5 is also fixed to the metal plaque 2 by fastening the smaller diameter portion of the touch piece 15 with a screw penetrating through the printed wiring board 5.

Figure 8:
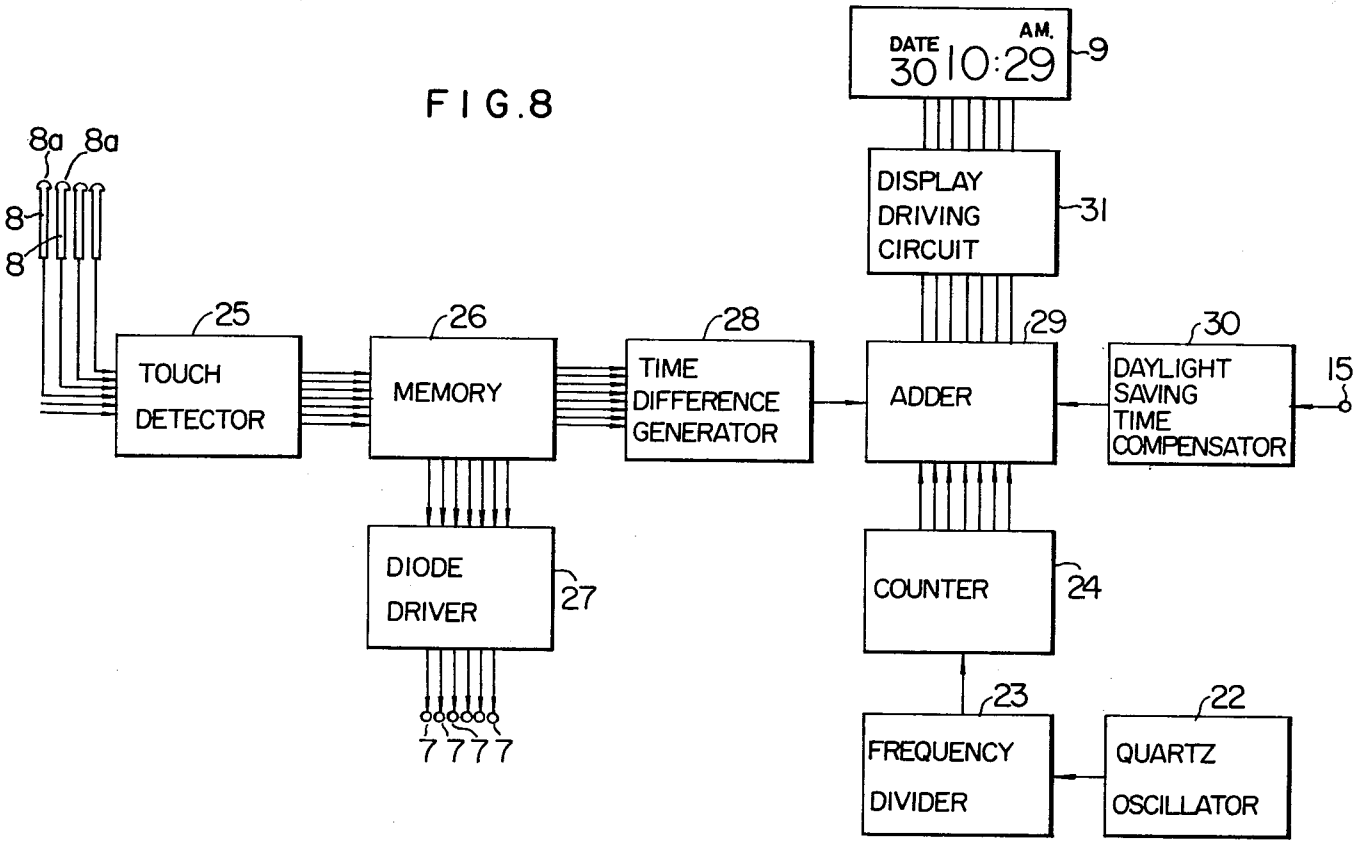
FIG. 8 is a block diagram schematically showing the electric circuit connection in the world clock of FIG. 1.

In the above embodiment, the clock circuit is formed as shown in FIG. 8. In FIG. 8, a quartz oscillator 22 generates the standard time signal and supplies it to a frequency divider 23, which outputs a signal of 1 Hz. A counter circuit 24 receives the 1 Hz signal from the frequency divider 23 and counts seconds, minutes, and hours. A touch detector circuit 25 detects the touch of a finger to the touch pins 8 and supplies a touch signal to a memory 26. An electroluminescent diode driving circuit 27 receives the output of the memory circuit 26 and drives electroluminescent diode 7 corresponding to a touch pin 8 touched by a finger. A time difference signal generator 28 receives the output of the memory circuit 26 and generates a signal corresponding to the time difference between the district corresponding to a touched pin 8 and the place of use. An adder circuit 29 adds the output of the counter circuit 24, i.e. the time signal for the place of use, and the time difference signal derived from the time difference signal generator 28. A daylight saving time compensating signal generator 30 generates a time difference signal of one hour when the touch piece 15 for compensating the daylight saving time is touched by a finger. A display driving circuit 31 receives the output of the adder circuit 29 and drives the time display board 9 formed of a liquid crystal display, etc.

In the above embodiment, when the touch pins 8 and the touch piece 15 for compensating for daylight saving time are not touched, no signal appears in the time difference signal generator 28 and in the daylight saving time compensating signal generator 30. Thus, the time signal of the place of use counted by the counter circuit 24 is directly applied to the driving circuit 31 in this case. And since the output signal of the driving circuit 31 is applied to the time display board 9, the time display board 9 displays the time at the place of use.

Now, let us consider the case when one would like to know the time at a district (city) other than the place of use, e.g. the time at Washington D.C. in the United States. In this case, one first looks for the position of Washington D.C. on the world map printed on the map board 4 and touches the pin head 8*a* of the touch pin 8 disposed at the position of Washington D.C. When the touch pin 8 provided at the position of Washington D.C. is touched by a finger, the touch detector circuit 25 detects the touch and the memory circuit 26 memorizes the touch on the pin at Washington D.C. The output of the memory circuit 26 drives the time difference signal generator 28 and the electroluminescent diode driver circuit 27 to light the electroluminescent diode at the position of Washington D.C. in the world map. On the other hand, the time difference signal generating circuit 28 receives the output of the memory circuit 26 and provides a time difference signal corresponding to the time difference between the place of use and Washington D.C. and applies this signal to the adder circuit 29. Thus, the adder circuit 29 provides an output formed of the sum of the time signal for the place of use and the time difference signal corresponding to the time difference between the place of use and Washington D.C., and hence the time display board 9 displays the time in Washington D.C. This display continues for the memory time of the memory circuit 26, e.g. 5 seconds. Then, the system returns to the state of displaying the time at the place of use.

When the desired district (city) employs daylight saving time, one only needs to touch the touch piece 15 to compensate daylight saving time after touching a touch pin 8 corresponding to a desired district (city). When a touch pin 8 corresponding to a desired district (city) and the touch piece 15 for compensating for daylight saving time are touched, a compensating signal for the time difference of one hour is supplied from the daylight saving time compensating signal generator 30 to the adder circuit 29 by the touch to the compensating touch piece 15 together with the application of the time difference signal corresponding to a designated district to the adder circuit 29. Thus, the time display board 9 automatically displays the time one hour advanced, i.e. the time at the desired district in the daylight saving time system.

As is apparent from the foregoing description, according to this embodiment of the world clock of this invention the cabinet of the world clock is formed of a wooden housing and a plaque formed of a metal plate of aluminium, etc., a time display board formed of a liquid crystal display, etc. is mounted above the plaque in a slanted state, and a world map board including electroluminescent diodes and touch pins corresponding to the respective districts on the world map is mounted on the plaque. By touching a touch pin, the time of the district corresponding to the touched pin can be correctly displayed on the time display board. Further, the electroluminescent diode corresponding to the touched district is turned on the clarify the time of the district the world clock is displaying. Thereby, anyone can easily know the time in a desired district. Further, the operation is done simply by touching a touch pin on the world map drawn on the world map board. Thus, the operability is also excellent. Further, according to the present world clock, since the time display board for displaying the time at various districts in the world is mounted at a slant angle formed with respect to the metal plaque, the read-out thereof is also very easy. Further, since the time display board is slanted and the cabinet comprises a wooden housing and a plaque of aluminium plate, etc. covering the opening in the plaque, the whole cabinet gives a profound impression of high grade goods, greatly increasing the commercial value of the total system.

Further, since the cabinet is comprised of a wooden housing and a metal plaque with a metal bottom plate attached to the outer surface of the bottom board of the wooden housing and the respective electric parts contained in the cabinet are fixed with respect to said bottom plate with screws, etc., the total appearance of the system gives a profound impression of high grade goods, which is very advantageous for commercial goods. Further, since a metal bottom plate is fastened on the outside of the bottom board of the housing and the respective electric parts are fixed to this bottom plate, the bottom board of the housing is well reinforced and the respective electric parts are also strongly supported compared to the case of fixing them directly to a wooden housing. This is very advantageous as a total system. Yet further, the world map board is assembled with a metal front plaque, and each pair of a touch pin and an electroluminescent diode is provided for each district in the world map board. When a touch pin is touch with a finger, a time display board displays the time in the district corresponding to the touched pin by the function of the clock circuit connected to the touch pins and the electroluminescent diode in the neighborhood of the touched pin is turned on. Since the designation of the various districts in the world is done through touch pins provided in correspondence to the various districts in the world map, it can be done very easily referring to the world map. Thus, the operability is greatly improved. Further, since the electroluminescent diodes are disposed in the neighborhoods of the touch pins and the electroluminescent diode disposed in the neighborhood of a touched pin is turned on, the correspondence between the designated district and the displayed time becomes apparent. Thus, the display effect is also very large.

Further, the time display means comprises a support means fitted in a cut-away seat formed on the inner periphery of an opening formed in a metal plaque, the support means including a back plate and a pair of triangular side plates and having another cut-away seat on the inner upper periphery, a plaque having a window opening and fitted in this another seat, a time display board formed of a liquid crystal display, etc. fitted in said seat, a metal stopper means attached to the lower surface of the periphery of the opening in the support means and supporting the lower end of said display board, thereby holding the display board in a slanted state. Since the display board is mounted with an angle slanted at respect to the metal plaque so as to be facing a view, the display in the display board can be very easily seen. Further, since the display board is fitted in a cut-away seat formed in the support means and engaged by a metal stopper means at the lower edge, it can be unloaded from the system through the opening in the metal plaque simply by removing the stopper means. Here, since the display board is drawn out inwardly in replacement, there occurs no problem which otherwise may occur due to the limited length of the lead wires to the display board. This is very advantageous from the point of practical use. There is formed a through hole having a large and a small diameter portions in a substrate for receiving a touch terminal. A ring having a large and a small diameter portion is inserted into this hole and a touch terminal having a large and a small diameter portion is further inserted in the ring. The touch terminal is fastened by a screw from a lower portion penetrating through a printed wiring board. This screw also provides an electric connection to the touch terminal. By this interfitting arrangement the touch terminal is fixed very strongly and also no lead wire is required to electrically connect the touch terminal to the wiring board due to the use of a fastening screw also as an electric connection. Thus, the structure of the touch terminal is very strong and yet the assembly is very easy.

In the above embodiment, the daylight saving time compensator is so connected as to add one hour time difference to the display time in response to the touch of a finger to the touch terminal, but it may also be coupled to a discriminator circuit for discriminating whether the designated district truly employs daylight saving time. In this case, if one touches a district pin and the daylight saving time compensating touch terminal by error since the designated district does not use daylight saving time in fact, the discriminator circuit discriminates the error information of the daylight saving time compensation and does not supply the additional one hour time difference signal to the adder circuit so that the correct time at the designated district can be displayed in the display board.

Figure 9:
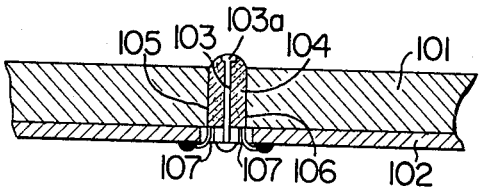
FIG. 9 shows another structure of the touch switch means to be used in the world clock of the present invention.
Figure 10:
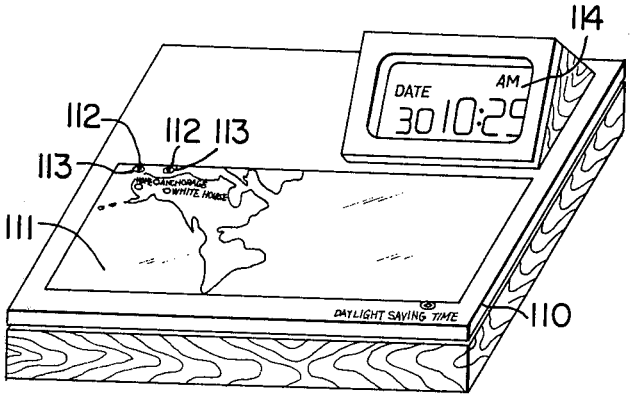
FIG. 10 is a perspective view of another embodiment of the world clock embodying the touch switch means of FIG. 9.
Figure 11:
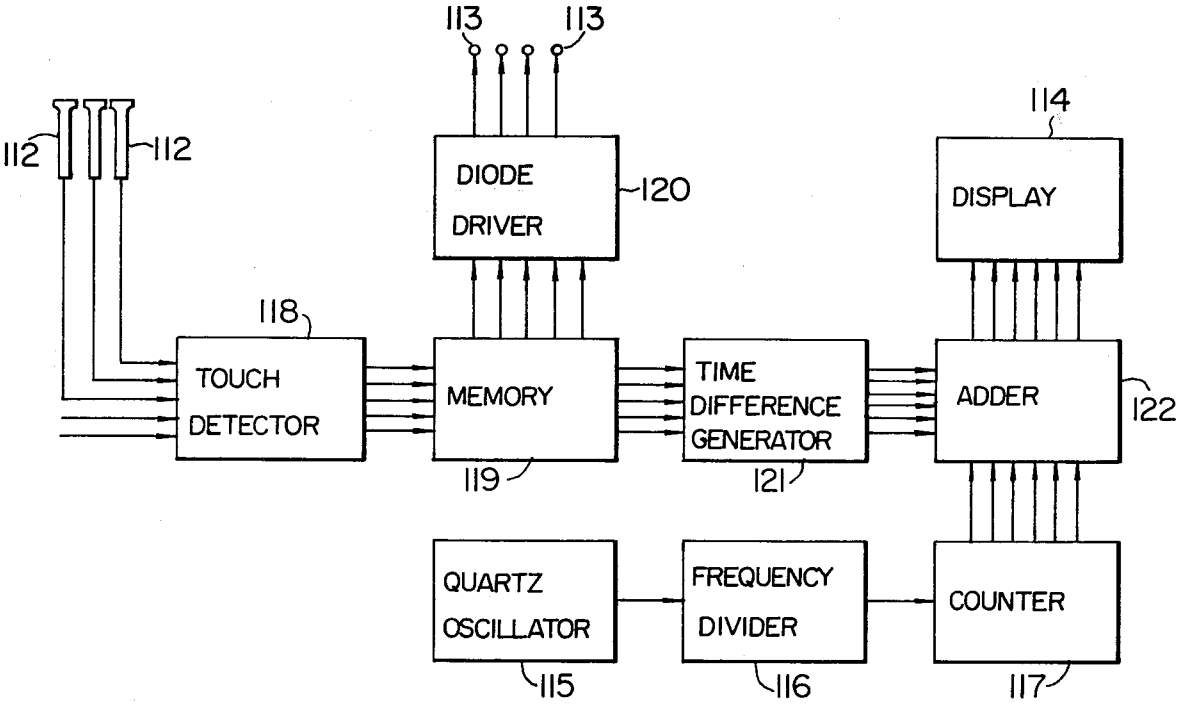
FIG. 11 is a block diagram of the circuit connection in the world clock of FIG. 10.

FIGS. 9 to 11 show another embodiment of the world clock according to this invention. FIG. 9 shows an integrated structure of a touch pin and a diode. In FIG. 9, numeral 101 indicates a mounting substrate, 102 a printed wiring board, 103 a touch pin disposed perpendicularly to the printed wiring board 102 and electrically and mechanically connected to a copper foil on the printed circuit board 102, 104 an electroluminescent diode inserted in a hole 105 formed in the mounting substrate 101 and having a central hole 106 through which the touch pin 103 is fitted.

The lead wires to the diode 104 are taken out to the back (lower) side of the printed circuit board 102 through holes 107 and soldered to the copper foil on the printed wiring board 102. A touch switch circuit is made of the printed wiring board 102 and various electric parts connected thereto so as to drive the electroluminescent diode 104 when the touch pin 103 is touched with a finger. The electroluminescent diode 104 is fixed to the substrate 101 in a manner to such that it's head partially projects above the substrate 101. The touch pin 103 has a pin head 103*a* at the top end and this pin head 103*a* is arranged to be exposed on the top end of the electroluminescence diode 104.

FIGS. 10 and 11 show a perspective view and an electric connection diagram of a world clock embodying the touch switch means of FIG. 9. In the figures, numeral 110 denotes a cabinet, 111 a mounting substrate mounted on the cabinet 110 and carrying a world map thereon. 112 and 113 touch pins and electroluminescent diodes integrated in pairs in a manner as shown in FIG. 9 and disposed in the world map corresponding to the respective districts (cities) in a similar manner to that of the foregoing embodiment, 114 a time display means of a liquid crystal display, etc. for digitally displaying the time at various districts in the world, 115 a quartz oscillator as the standard signal source, 116 a frequency divider receiving the output of the quartz oscillator 115 and supplying 1 Hz signal, 117 a counter receiving the 1 Hz signal from the frequency divider 116 and counting the time (date, hours, minutes, and seconds) at the place of use, 118 a touch detector circuit for detecting the touch of a finger to a touch pin 112 and generating a signal corresponding to the designated district, 119 a memory circuit for storing the output of this touch detector circuit 118, 120 an electroluminescent diode driving circuit for receiving the output of the memory circuit 119 and lighting the electroluminescent diode 113 fitted around the touched touch pin 112, 121 a time difference signal generating circuit for receiving the output of the memory circuit 119 and generating a signal corresponding to the time difference between the place of use and the designated place, and 122 an adder circuit for adding the outputs of the counter 117 and the time difference signal generator 121.

When no touch pin is touched with a finger in the system of FIGS. 10 and 11, no output appears from the touch detecting circuit 118 and all the electroluminescence diodes 113 are turned off. In this case, the output of the counter 117 is directly applied to the time display means 114 to display the time at the place of use in the time display means 114.

When a touch pin 112 disposed on a desired district in the world map drawn on the substrate 111 is touched with a finger, the touch detecting circuit 118 detects this touch and the memory circuit 119 stores this information. Thus, the diode driving circuit 120 is activated by the output of the memory circuit .119 and drives the electroluminescent diode 113 fitted around the touch pin 112 touched by a finger to turn the light on. Since the output of the memory circuit 119 is also supplied to the time difference signal generating circuit 121, the time difference signal generator 121 generates a time difference signal corresponding to the time difference between the place of use and the designated district in which the touch pin 112 touched by a finger exists in the world map. Thus, the output of the adder circuit becomes the sum of the time signal for the place of use and the time difference signal derived from the time difference signal generating circuit 121 and the time display means 114 displays the time at the district in which the touch pin touched with a finger exists in the world map.

As is described above, according to this embodiment the touch indicator is formed electroluminescent diode having a central hole and a touch pin inserted in the central hole of the diode with an electric circuit for driving the electroluminescent diode to turn on when the touch pin is touched with a finger. Since the electroluminescent diode for displaying a touched position and the touch pin for driving the diode occupy almost perfectly the same position, the display effects in the world map is greatly enhanced. Further, since the area occupied by the touch pin and a diode can be reduced to a very small size, this arrangement is particularly advantageous in the case of disposing many touch pins and electroluminescent diodes in a world map of a limited size.

Figure 12:
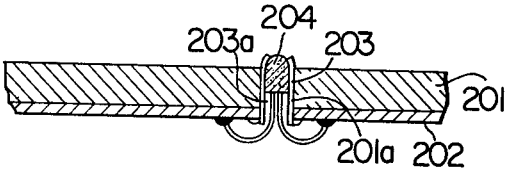
FIG. 12 is a cross-sectional view of another structure of the touch switch means to be used in the world clock of the present invention.

Another integrated structure of a touch pin and an electroluminescent diode is shown in FIG. 12. In FIG. 12, a cylinder-shaped touch piece 203 is inserted into a hole 201*a* formed in a mounting substrate 201 and soldered at the bottom edge to a copper foil on a printed wiring board 202 disposed under the substrate 201 to electrically and mechanically connect the touch piece 203 to the printed wiring board 202. An electroluminescent diode 204 is inserted into the central hollow 203*a* of the cylindrical touch piece 203 so as to light up the electroluminescent diode 204 by touching the touch piece 203 around the diode 204. In this case too, an electroluminescent diode and a touch piece occupy almost perfectly the same position. Thus, the display effect is greatly enhanced similar to the structure of FIGS. 10 and 11. Similarly, since the occupation area for a touch piece and a diode can be reduced very much, this structure is particularly advantageous in the case of disposing many touch pieces and electroluminescent diodes in a world map of a limited size.

What is claimed is:

1. A world clock comprising:

a cabinet including an open box and a front plaque having a central opening for exposing a world map;

a time display means including a time display board mounted above the upper surface of said front plaque;

a world map board attached to said front plaque and exposed through said opening;

a plurality of touch indicator means, each including a touch pin and marking light source disposed in the neighborhood of each other and in correspondence to respective districts in said world map board; and display circuit means for turning on a marking light corresponding to a touch pin touched with a finger and displaying the time at the district designated by said touched pin in said time display board, wherein said open box is formed of wood and said front plaque is formed of a metal plate disposed to cover the open end of said open box, and further comprising a metal bottom plate disposed on the outer surface of the bottom plate of said box and fastening means penetrating through said metal bottom plate and the bottom plate of said box for attaching electric parts contained in said box.

2. A world clock comprising:

a cabinet including an open box and a front plaque having a central opening for exposing a world map;

a time display means including a time display board mounted above the upper surface of said front plaque;

a world map board attached to said front plaque and exposed through said opening;

a plurality of touch indicator means, each including a touch pin and a marking light source disposed in the neighborhood of each other and in correspondence to respective districts in the world map board; and display circuit means for turning on a marking light corresponding to a touch pin touched with a finger and displaying the time at the district designated by said touched pin in said time display board, wherein said front plaque has another opening for mounting the time display means, the opening being provided with a U-shaped seat, and said time display means includes support means consisting of a rectangular back plate and a pair of triangular side plates both fitted on said U-shaped seat to form a slanted opening, further comprising a cut-away seat provided on the upper inner edge of said support means, another plaque for the time display board having an opening window for exposing the time display board, said time display board and said another plaque being fitted in said seat in the support means, stopper means attached to the inner surface of said front plaque at the periphery of said another opening for supporting the lower edge of said time display board, the time display board being thereby supported at a slant angle with respect to said front plaque.

3. A world clock comprising:

a cabinet including an open box and a front plaque having a central opening for exposing a world map;

a time display means including a time display board mounted above the upper surface of said front plaque;

a world map board attached to said front plaque and exposed through said opening;

a plurality of touch indicator means, each including a touch pin and a marking light source disposed in the neighborhood of each other and in correspondence to respective districts in the world map board;

display circuit means for turning on a marking light corresponding to a touch pin touched with a finger and displaying the time at the district designated by said touched pin in said time display board;

a touch switch means for compensating for daylight saving time disposed on said front plaque; and said display circuit means displaying daylight saving time at a designated district in said time display board by touching a touch pin on said world map board and then the touch switch for compensating for daylight saving time when the desired district employs daylight saving time, wherein said front plaque is provided with a through hole having large and small diameter portions, said touch switch means for compensating for daylight saving time including a resilient ring for insertion into said hole and a touch terminal, both said ring and said touch terminal having large and small diameter portions, and said display circuit means includes a printed wiring board disposed on the lower surface of said front plaque and a screw penetrating through said printed wiring board and fixed into the small diameter portion of said touch terminal to electrically and mechanically connect said touch terminal and said printed wiring board.

4. A world clock comprising:

a cabinet including an open box and a front plaque having a central opening for exposing a world map;

a time display means including a time display board mounted above the upper surface of said front plaque;

a world map board attached to said front plaque and exposed through said opening;

a plurality of touch indicator means, each including a touch pin and a marking light source disposed in the neighborhood of each other and in correspondence to respective districts in the world map board; and display circuit means for turning on a marking light corresponding to a touch pin touched with a finger and displaying the time at the district designated by said touched pin in said time display board, wherein said display circuit means includes a printed wiring board disposed under the world map board, said touch indicator means includes a marking light source having a central through hole and a touch pin inserted through said central hole of the light source to project a head portion thereabove and having a base portion electrically and mechanically connected to said printed wiring board, and said world map board has through holes for exposing the top portions of said light sources above the map plane.

5. A world clock comprising;

a cabinet including an open box and a front plaque having a central opening for exposing a world map;

a time display means including a time display board mounted above the upper surface of said front plaque;

a world map board attached to said front plaque and exposed through said opening;

a plurality of touch indicator means, each including a touch pin and a marking light source disposed in the neighborhood of each other and in correspondence to respective districts in the world map board; and display circuit means for turning on a marking light corresponding to a touch pin touched with a finger and displaying the time at the district designated by said touched pin in said time display board, wherein said display circuit means includes a printed wiring board disposed under the world map board, said touch indicator means includes a cylindrical touch piece having a base portion electrically and mechanically connected to said printed wiring board and a light source inserted into a central hollow of said cylindrical touch piece to project a head portion above the touch piece, and said world map board has through holes for exposing the top portion of said cylindrical touch piece above the map plane.

* * * * *